United States Patent [19]

Gawlick et al.

[11] 4,145,969

[45] Mar. 27, 1979

[54] PRIMING SYSTEM FOR HIGH-TEMPERATURE STABLE PROPELLANTS

[75] Inventors: Heinz Gawlick, Vagen; Günther Marondel, Erlangen; Werner Sieglein, Nuremberg, all of Fed. Rep. of Germany

[73] Assignee: Dynamit Nobel AG, Troisdorf, Fed. Rep. of Germany

[21] Appl. No.: 841,632

[22] Filed: Oct. 12, 1977

[30] Foreign Application Priority Data

Oct. 2, 1975 [DE] Germany ..... 25439718

Related U.S. Application Data

[63] Continuation of Ser. No. 729,322, Oct. 4, 1976, abandoned.

[51] Int. Cl.[2] ..... F42C 19/08; C06B 25/04; C06B 25/02

[52] U.S. Cl. ..... 102/204; 149/105; 149/108.6

[58] Field of Search ..... 102/70 R, 86.5, 204; 149/92, 105, 106, 108.6; 260/645, 568, 571, 576, 308 D

[56] References Cited

U.S. PATENT DOCUMENTS

| | | | |
|---|---|---|---|
| 3,040,055 | 6/1962 | Fetter | 260/308 D |
| 3,173,921 | 3/1965 | Einberg | 260/308 D |
| 3,418,372 | 12/1968 | Taylor | 102/86.5 |
| 3,558,720 | 1/1971 | Collerus | 149/105 |
| 3,562,332 | 2/1971 | Collerus | 149/105 |
| 3,611,939 | 10/1971 | Stadler | 102/86.5 |
| 3,659,527 | 5/1972 | Abegg | 149/105 |
| 3,899,536 | 8/1975 | Girardon | 260/576 |

*Primary Examiner*—Charles T. Jordan
*Assistant Examiner*—Donald P. Walsh
*Attorney, Agent, or Firm*—Sprung, Felfe, Horn, Lynch & Kramer

[57] ABSTRACT

A priming system for propellants having thermal decomposition points above 180° C. comprising:

A. an ignition charge; and

B. a booster charge of solid explosive compound containing one or more $—NO_2$ groups and/or —N=N end groups and having a deflagration point above 200° C., said booster charge containing an initiating explosive in an amount between 10% and 60% by weight;

the amount of the ignition charge A being between 2 and 20 weight % of the booster charge B.

15 Claims, No Drawings

PRIMING SYSTEM FOR HIGH-TEMPERATURE STABLE PROPELLANTS

This is a continuation of application Ser. No. 729,322, filed Oct. 4, 1976, now abandoned.

BACKGROUND OF THE INVENTION

1. Field of the Invention

This invention relates to a priming system for propellants having a thermal decomposition point above 180° C. More particularly this invention relates to a priming system for such propellants characterized in that the priming system contains a known ignition charge, together with a booster charge, the booster charge being of a solid explosive compound containing one or more $—NO_2$ and/or —N=N end groups and 10 to 60 weight % of an initiating explosive.

2. Discussion of the Prior Art

The priming systems known hitherto for case-less ammunition are based on nitrocellulose, sometimes mixed with other gas-yielding substances, such as glycerin trinitrate. These propellants have thermal decomposition points up to a maximum of 180° C.; they can be ignited perfectly well by the known priming mixtures based on initiating explosives or pyrotechnical mixtures.

The above-mentioned known propellants, however, have been improved so as to have greater animal stability. These more stable propellants contain organic compounds having terminal $>N—NO_2$ groups or heterocyclic aliphatic and aromatic compounds whose thermal decomposition points are in some cases appreciably higher than the decomposition point of nitrocellulose, which is 170° to 180° C.

The ignition of these high temperature-resistant propellants which the known priming mixtures based on initiating explosives involves considerable difficulty. The ignition must be accomplished such that the propellant will be completely burned up by the initiated chemical reaction, leaving no solid residues; on the other hand the priming mixture must not be so powerful as to transform the desired burning action to a detonation.

Attempts have been made to ignite such propellant charges with the known priming charges. To obtain a continuous ignition, however, it was found necessary to increase the power of the priming charge in relation to the normal, nitrocellulose-based propellant. This increase of power alone, however, did not result in a uniform and complete reaction of the propellant. Additionally therefore, the geometrical shape of the propellant charge had to be modified such that the ignition spurt of the primer would contact the maximum surface area of the propellant. This was achieved, for example, by shaping the propellant charge into an elongated hollow cylinder or hollow block, so that the ignition spurt contacted nearly the entire inside surface of the hollow body. The wall thickness of the hollow body must be slight, so that the heat produced by the ignition will be transferred over as large an area as possible and the reaction will progress uniformly even within this thin layer and not stop half-way through it.

This type of construction involves disadvantages in the manufacturing process. Also, it has its limitations with regard to the geometry which make it impossible to take advantage of the other benefits which are offered by the use of case-less ammunition.

SUMMARY OF THE INVENTION

The disadvantages in the use of known priming systems for propellants having a thermal decomposition point above 180° C. is overcome in accordance with the present invention, which provides a priming system for such propellant comprising:

A. an ignition charge; and

B. a booster charge of a solid explosive compound containing one or more $—NO_2$ groups and/or —N=N groups and having a deflagration point above 200° C., said solid explosive compound being combined with between 10 and 60% by weight of an initiating explosive, the amount of ignition charge A being between 2 and 20 weight % of the booster charge B.

It has been found that an effective priming system for a propellant having a reaction temperature above 180° C. can be provided if a booster charge is provided of a solid explosive compound containing one or more $—NO_2$ groups and/or N=N groups, which solid explosive has a deflagration point above 200° C. The booster charge contains between 10 and 60 weight % of an initiating explosive. The priming system contains an amount of ignition charge of between 2 and 20 weight % of the booster charge.

In the use of this priming system, the above-described disadvantages of the priming charges of the prior art are eliminated: After ignition, the booster charge acts upon only a small surface area of the propellant body. Despite the small contact area, the propellant body is shattered and brought to a complete reaction. Thus, the surface area of the propellant is not enlarged until the ignition is in progress. Accordingly, it is not necessary to perform a separate forming procedure to give the propellant charge a special geometric shape of great surface area. Instead, it is made possible in this manner for the propellant body together with the projectile to be contained in a very small space, and especially for case-less ammunition to have a compact and mechanically strong construction. Cavities within the interior of the cartridge are no longer necessary.

The term "compounds containing $NO_2$ groups", as used herein, is intended to include both nitro compounds and nitramines.

The booster charge of the priming system of the invention contains a solid organic nitro compound. The solid organic nitro compounds contemplated are those known as dangerous explosives and defined in the "Gesetz uber explosionsgefahrliche Stoffe" (West German Explosives Law) of Aug. 25, 1969, the contents of which are hereby incorporated herein by reference. These solid, dangerous explosives which can be employed in the booster charge of the invention are those having one or more $—NO_2$ groups and/or —N=N groups and have a deflagration point above 200° C. Particularly contemplated dangerously explosive solid nitro compounds are the following: hexanitrodiphenyl, hexanitrodiphenyloxide, hexanitrodiphenyloxamide, hexanitrodiphenylsulfon, hexanitrodiphenylsulfide, hexanitrodiphenylamine tetranitrocarbazol, tetranitroaniline, hexanitrostilbene, hexanitroanilide, cyclotetramethylentetranitramine. In addition to the foregoing solid nitro compounds, other compounds are useful, including in particular derivatives of hexanitrodiphenyl of the general formula

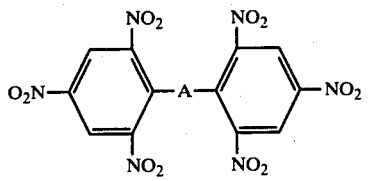

wherein A represents the group

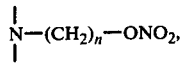

wherein n is a whole number between 1 and 3, or A represents the group —NH—CO—CO—HN— or —N-H—CO—HN.

Additionally contemplated compounds useful as solid, dangerous explosives in accordance with the present invention are the nitromines of which hexogen, octogen and tetryl are particularly contemplated. Useful azo compounds for inclusion in the booster charge as the solid explosive compounds include the triazoles, tetrazole and its derivatives, such as, for example, 5-aminotetrazole, guanylamino-5-tetrazole, 1-guanyl-3-tetrazolyl-5-guanidine, ditetrazole, diaminoguanidinediteterazole, diaminoguanadine azotetrazole. In general, the usable nitro, nitramino and azo compounds have a melting point above 140° C., a deflagration point above 200° C. and a nitrogen content above 17%. Their sensitivity to mechanical stress should be lower than that of initiating explosives, i.e., it must assume values above one Joule. The specific energy they develop is to have values between about 850 and 1400 kj/kg.

The booster charge of the priming system of the invention is to have reaction speeds corresponding to those of the ignition charge. In general, these reaction speeds are between 1000 and 4000 m/sec. The booster charge accordingly must not react with detonation.

A detonative reaction of the booster charge is brought about by the limited addition of the initiating explosives to the booster charge. These are contained in the booster charge in amounts between 10 and 60% by weight. By varying their amount or that of the substances put in, a speed of reaction can be achieved in the booster charge which will correspond to that of the ignition charge.

Suitable initiating explosives in the booster charge are, for example, heavy metal azides, preferably lead azide, heavy metal salts of mono-, di- and trinitroresorcinol, preferably salts of lead, barium or thallium, lead phloroglucinate, heavy metal picrates, preferably lead picrate, azotetrazole lead, or diazodinitrophenol.

The booster charge is best shaped or pressed to form small cylinders whose diameter is determined by the caliber of the cartridge. The weight of the booster charge is to be in a ratio of 1:5–20 to the weight of the propellant charge. For case-less cartridges of small caliber, the weight of a booster charge is approximately 200 mg.

The amount of the igniting composition placed ahead of the booster charge and designed to ignite the latter amounts to between 2 and 20 wt. %, preferably 5 and 10 wt. %, of the booster charge. This igniting charge is ignited by mechanical shock. It is in immediate contact with the booster charge.

The ignition compositions used in the priming system are those compounds and mixtures known in the art for the ignition of propellant charges. Accordingly, the above-named initiating explosives used in the booster charge can be used. However, pyrotechnical ignition mixtures, such as, for example, a mixture of 80% of a certain-magnesium alloy and 20% of lead oxide, are suitable.

The ignition charge is preferably also compressed into cylinders whose diameter is preferably the same as that of the booster charge. Other compositions useful as the ignition charge include: tetrazene, mixtures of $KClO_3$ with glasspowder, mixtures of $KClO_3$ with P or fine powdered metals as Mg, B; Pb-dinitroresorcinate, diazodinitrophenol, Pb-trinitrophloroglucinate.

If the priming system is of cylindrical shape, it has preferably a maximum diameter of 5 mm and a length amounting to no more than three to four times the diameter.

The igniting of the primer mixture is accomplished by means of a firing pin. The case-less cartridge then burns uniformly and leaves no residue.

In order more fully to illustrate the nature of the invention and the manner of practicing the same, the following examples are presented:

EXAMPLE 1

A mixture of 70 weight-parts of hexanitrodiphenyl ether and 30 weight-parts of lead trinitromesorcinate were pressed to form booster cylinders of about 16 mm length with a diameter of approximately 4 mm, using a pressing force of 0.6 Mp.

This booster charge was combined with 0.02 g of a tin-oxide ignition charge and 2.2 g of high-temperature-resistant propellant to form a case-less cartridge in the following manner:

(a) The ignition charge was pressed onto the booster charge and the entire body was inserted from the rear end into a central through-bore in the cylindrically pressed propellant body. The bullet was placed on the front end of the central bore on the primer and cemented there.

(b) The propellant which was pressed to form two propellant halves of identical shape having recesses for the accommodation of the booster charge, the ignition mixture and the bullet. The geometrical location of these recesses was such that, on the one hand the bullet served as an anvil, and on the other hand a direct junction existed between the ignition charge and the booster charge. After the insertion of the bullet and the booster charge into the appropriate recesses, the two propellant halves were cemented together to form the actual cartridge.* The remaining recess provided for the ignition mixture was filled with the latter in paste form.

*The propellant had an ignition point over 180° C. and consisted of a heterocyclic nitro compound and an organic binder.

Ignition was performed in both cases with a firing pin. The propellant charge burned uniformly and no residues were left.

EXAMPLES 2 to 9

In the same manner as in Example 1, a priming system was prepared using the mixtures given in the following table, and was used to ignite the propellant charge described in Example 1, in the same manner. The results were the same as those of Example 1.

| Example | Primer charge Composition (see following page) | Booster charge Composition | Amount Weight Parts |
|---|---|---|---|
| 2 | | Hexanitrodiphenylsulfone | 75 |
| | | Lead azide | 25 |
| 3 | | Hexanitrostilbene | 65 |
| | | Lead trinitroresorcinate | 35 |
| 4 | | Hexanitrodiphenylamine | 75 |
| | | Lead azide | 25 |
| 5 | | Hexanitrodiphenylaminonitrate | 60 |
| | | Lead phloroglucinate | 40 |
| 6 | | Hexanitrodiphenylsulfide | 70 |
| | | Lead picrate | 30 |
| 7 | | Hexanitronilide | 85 |
| | | Diazodinitrophenol | 15 |
| 8 | | Diaminoquanidinetetrazole | 60 |
| | | Lead azide | 40 |
| 9 | | Octogen | 50 |
| | | Lead azide | 50 |

| Composition | Example 2 | 3 | 4 | 5 | 6 | 7 | 8 | 9 |
|---|---|---|---|---|---|---|---|---|
| Pb—trinitroresorcinate | 38 ± 5 % | 34 ± 5 % | 38 ± 5 % | 40 ± 6 % | 43 ± 6 % | 43 ± 6 % | 43 ± 6 % | — |
| Tetrazen | 3 ± 3 % | 3 ± 3 % | 3 ± 3 % | 3 ± 3 % | 3 ± 3 % | 3 ± 3 % | 3 ± 3 % | 4 ± 3 % |
| $Ba(NO_3)_2$ | 38 ± 5 % | 44 ± 5 % | 38 ± 5 % | 36 ± 5 % | 38 ± 5 % | 44 ± 6 % | 38 ± 5 % | — |
| $PbO_2$ | 5 ± 3 % | 5 ± 2 % | 5 ± 3 % | 5 ± 3 % | — | 5 ± 3 % | 2 ± 2 % | — |
| $Sb_2S_3$ | 5 ± 3 % | 14 ± 3 % | 5 ± 3 % | 5 ± 3 % | 10 ± 3 % | 5 ± 3 % | 11 ± 3 % | 31 ± 5 % |
| Ca-silicide | 11 ± 3 % | — | 11 ± 3 % | 11 ± 3 % | 6 ± 3 % | — | 3 ±3 % | — |
| $KClO_3$ | — | — | — | — | — | — | — | 50 ± 6 % |
| Powdered glass | — | — | — | — | — | — | — | 15 ± 3 % |

What is claimed is:

1. A priming system for a propellant having a thermal decomposition point above 180° C. comprising:

A. an ignition charge selected from the group consisting of heavy metal azites, heavy metal salts of mono-, di- and trinitroresorcinol, lead phloroglucinate, heavy metal picrates, azotetrazole lead, diazodinitrophenol, and a mixture of 80% of a cerium-magnesium alloy and 20% of lead oxide; and B. a booster charge of a mixture of B1. a solid explosive compound having one or more —$NO_2$ groups and/or —N=N groups and having a deflagration point above 200° C., said solid explosive compound being selected from the group consisting of hexanitrodiphenyl, hexanitrodiphenyl oxide, hexogen, octogen, tetryl, a triazole, a tetrazole, 5-aminotetrazole, guanylamino-5-tetrazole, 1-guanyl-3-tetrazolyl-5-guanidine, ditetrazole, diaminoguanidineditetrazole, diaminoguanidine azotetrazole, hexanitrodiphenyloxamide, hexanitrodiphenylsulfone, hexanitrodiphenylsulfide, hexanitrodiphenylamine, tetranitrocarbazole, tetranitroaniline, hexanitrostibene, hexanitroanilide, cyclotetramethylenetetranitramine and a hexanitrodiphenyl of the formula

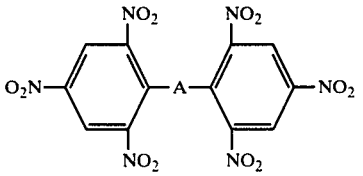

wherein A represents the group

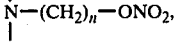

wherein n is a whole number between 1 and 3, or A represents the group —NH—CO—CO—HN— or —NH—CO—HN—; and B2. between 10 and 60% by weight of an initiating explosive selected from the group consisting of heavy metal azides, heavy metal salts of mono-, di- and trinitroresorcinol, lead phlorogludinate, heavy metal picrates, azotetrazole lead and diazodinitrophenol, the amount of the ignition charge A being between 2 and 20% by weight of the booster charge B.

2. A priming system according to claim 1 wherein the explosive composition contains a —$NO_2$ group.

3. A priming system according to claim 1 wherein an explosive compound contains a —N=N end group.

4. A priming system according to claim 1 wherein the explosive is a hexanitrodiphenyl or a derivative thereof.

5. A priming system according to claim 1 wherein the solid explosive compound is hexanitrodiphenyl oxide.

6. A priming system according to claim 1 wherein the solid explosive compound is tetrazole or its derivative.

7. A priming system according to claim 1 wherein there are two charges which are pressed together to form cylinders whose diameter amounts to not more than 5 mm and whose length amounts to at most 3× to 4× the diameter.

8. A priming system according to claim 1 wherein the solid explosive compound is a hexanitrodiphenyl of the general formula

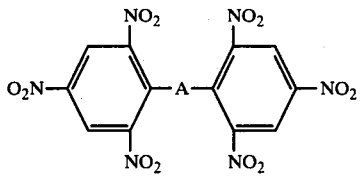

wherein A represents the group

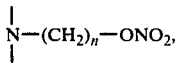

wherein n is a whole number between 1 and 3, or A represents the group —NH—CO—CO—HN— or —NH—CO—HN—.

9. A priming system according to claim 1 wherein the solid explosive compound is selected from the group consisting of triazoles, tetrazole, 5-aminotetrazole, guanylamino-5-tetrazole, 1-guanyl-3-tetrazolyl-5-guanidine, ditetrazole, diaminoguanidineditetrazole and diaminoguanadine azotetrazole.

10. A priming system according to claim 1 wherein the initiating explosive is selected from the group consisting of heavy metal azides, heavy metal salts of mono-, di- and trinitroresorcinol, lead phloroglucinate, heavy metal picrates, azotetrazole lead and diazodinitrophenol.

11. A priming system according to claim 1 wherein the ignition charge is positioned successively with respect to the booster charge.

12. A priming system according to claim 1 wherein the ignition charge is a pyrotechnical ignition mixture.

13. A priming system according to claim 1 wherein the ignition charge is a mixture of 80% of a cerium-magnesium alloy and 20% of lead oxide.

14. A priming system according to claim 1 wherein the ignition charge is selected from the group consisting of heavy metal azides, heavy metal salts of mono-, di- and trinitroresorcinol, lead phloroglucinate, heavy metal picrates, azotetrazole lead and diazodinitrophenol.

15. A priming system according to claim 1 wherein said solid explosive compound is hexogen, octogen or tetryl.

* * * * *

UNITED STATES PATENT AND TRADEMARK OFFICE

CERTIFICATE OF CORRECTION

PATENT NO. : 4,145,969

DATED : March 27, 1979

INVENTOR(S) : GAWLICK et al.

It is certified that error appears in the above-identified patent and that said Letters Patent are hereby corrected as shown below:

Column 4, line 7, "certain" should read -- cerium --.

Column 4, line 30, "trinitromesorcinate" should read -- trinitroresorcinate --.

Column 5, line 57-58, "hexanitrostibene" should read -- hexanitrostilbene --.

Signed and Sealed this

*Seventeenth* Day of *July 1979*

[SEAL]

*Attest:*

*Attesting Officer*

LUTRELLE F. PARKER

*Acting Commissioner of Patents and Trademarks*